US006147660A

United States Patent [19]

Elliott

[11] Patent Number: 6,147,660

[45] **Date of Patent: *Nov. 14, 2000**

[54] MOLDED ANTENNA

[75] Inventor: Michael Elliott, Poriya Illit, Israel

[73] Assignee: Galtronics Ltd., Tiberias, Israel

[ * ] Notice: This patent issued on a continued prosecution application filed under 37 CFR 1.53(d), and is subject to the twenty year patent term provisions of 35 U.S.C. 154(a)(2).

[21] Appl. No.: 09/008,473

[22] Filed: Jan. 16, 1998

Related U.S. Application Data

[60] Provisional application No. 60/048,426, Jun. 3, 1997, and provisional application No. 60/048,400, Jun. 3, 1997.

[51] Int. Cl.[7] ..... H01Q 1/36

[52] U.S. Cl. ..... 343/895

[58] Field of Search ..... 343/895, 702; 455/575, 90

[56] References Cited

U.S. PATENT DOCUMENTS

| | | | |
|---|---|---|---|
| 4,147,911 | 4/1979 | Nishitani | 219/10.55 M |
| 4,170,014 | 10/1979 | Sully | 343/749 |
| 4,435,713 | 3/1984 | Gasparaitis et al. | 343/702 |
| 4,862,184 | 8/1989 | Ploussios | 343/745 |
| 5,343,213 | 8/1994 | Kottke et al. | 343/702 |
| 5,495,262 | 2/1996 | Klebe | 343/853 |
| 5,650,787 | 7/1997 | Lim et al. | 342/375 |
| 5,650,789 | 7/1997 | Elliott et al. | 343/702 |
| 5,986,621 | 11/1999 | Barts et al. | 343/895 |

FOREIGN PATENT DOCUMENTS

| | | |
|---|---|---|
| 9712417 | 4/1997 | WIPO . |

*Primary Examiner*—Don Wong
*Assistant Examiner*—James Clinger
*Attorney, Agent, or Firm*—Ladas & Parry

[57] ABSTRACT

A method for producing an antenna, by introducing a moldable material into a mold and molding the material in the mold into an antenna having a desired shape, preferably a helical shape. The method is used to produce an antenna including a generally rigid, conductive coil, which is mechanically self-supporting.

14 Claims, 2 Drawing Sheets

MOLDED ANTENNA

RELATED APPLICATIONS

The present application claims the benefit of U.S. Provisional Patent Application Ser. Nos. 60/048,426 and 60/048,400, both filed Jun. 3, 1997, which are assigned to the assignee of the present patent application and incorporated herein by reference.

FIELD OF THE INVENTION

The present invention relates generally to antennas, and specifically to methods for producing antennas.

BACKGROUND OF THE INVENTION

Helical coil antennas are well known in the art and are particularly widely used in communications systems in the megahertz and gigahertz range, such as in cellular telephones. An example of such a helical antenna designed for use in a personal communication device may be found in U.S. patent application Ser. No. 08/541,913, which is assigned to the assignee of the present patent application, and whose disclosure is incorporated herein by reference.

Helical antennas typically comprise a coil wound around a central core. The process of winding the core is a complicated and expensive process, generally requiring production and assembly of multiple parts and precision winding of a fine wire. There is a need to simplify this manufacturing process, in order to reduce the cost and increase the reliability of the antenna.

SUMMARY OF THE INVENTION

It is an object of some aspects of the present invention to provide an improved method for producing antennas, particularly helical antennas.

It is a further object of some aspects of the present invention to provide antennas produced in accordance with such methods.

In preferred embodiments of the present invention, a helical antenna is produced by molding the antenna out of a suitable, moldable material. The molded material itself preferably comprises an electrical conductor. Alternatively or additionally, the material may be coated with a conductive material after molding. In either case, the wire-winding step that is typically required to produce helical antennas is eliminated, and the molded antenna can thus be made more reliable and less expensive than antennas known in the art.

In some preferred embodiments of the present invention, the antenna is molded from a metal material, preferably zinc.

In other preferred embodiments, the antenna is molded from plastic material with conductive particles embedded therein, such as carbon or metal particles. Such plastics are not in themselves particularly conductive, and it is therefore preferred that antennas so made are sintered or otherwise heat-treated to enhance their conductivity, as part of the manufacturing process. Preferably, antennas in accordance with such embodiments are produced using Metal Injection Molding (MIM) methods of manufacturing, as are known in the art.

In still other preferred embodiments, the antenna is molded from plastic material and is then coated with any suitable conductive coating, preferably, a metallic coating such as copper, using a process such as electroplating.

While helical antennas known in the art typically have symmetrical, generally circular cross-sections, the principles of the present invention are particularly advantageous for producing helical antennas having non-circular and non-symmetrical cross-sections. Such a cross-section can give the antenna an increased aperture, and can be made to particularly increases the aperture in some directions and not in others, as described in greater detail in the above-mentioned U.S. Provisional Patent Application Ser. No. 60/048,400, which is assigned to the assignee of the present patent application and incorporated herein by reference. Antennas of this type are ordinarily very difficult to produce by conventional winding methods, but may be manufactured with relative ease by molding.

While the preferred embodiments described hereinabove relate specifically to helical antennas, it will be appreciated that antennas of other types may also be produced by methods of molding, in accordance with the principles of the present invention.

There is therefore provided, in accordance with a preferred embodiment of the present invention, a method for producing an antenna including:

introducing a moldable material into a mold; and molding the material in the mold into an antenna having a desired shape.

Preferably, molding the material includes forming a helical shape.

Further preferably, introducing the material includes introducing a metal material.

Alternatively, introducing the material includes introducing a plastic material, wherein introducing the plastic material preferably includes mixing conductive particles into the material. Preferably, the molded material is then sintered.

In a preferred embodiment, the molded material is coated with a conductive coating.

There is further provided, in accordance with a preferred embodiment of the present invention, an antenna having a predetermined shape, preferably helical, including a moldable material which is molded to produce the predetermined shape.

Preferably, the material includes metal material.

Alternatively, the material includes a plastic material, wherein metal particles are preferably mixed into the plastic material. Preferably, the material is sintered after molding.

There is also provided, in accordance with a preferred embodiment of the present invention, an antenna including a generally rigid, conductive coil, which is mechanically self-supporting.

Preferably, the coil includes a molded plastic material, wherein the molded plastic material preferably includes conductive particles.

Alternatively, the coil includes a metal material.

In a preferred embodiment, the coil is coated with a conductive material.

Preferably, the antenna includes a connector, formed integrally with the coil, for connecting the antenna to a communication device, preferably a cellular telephone.

The present invention will be more fully understood from the following detailed description of the preferred embodiments thereof, taken together with the drawings in which:

DETAILED DESCRIPTION OF PREFERRED EMBODIMENTS

Figure 1:
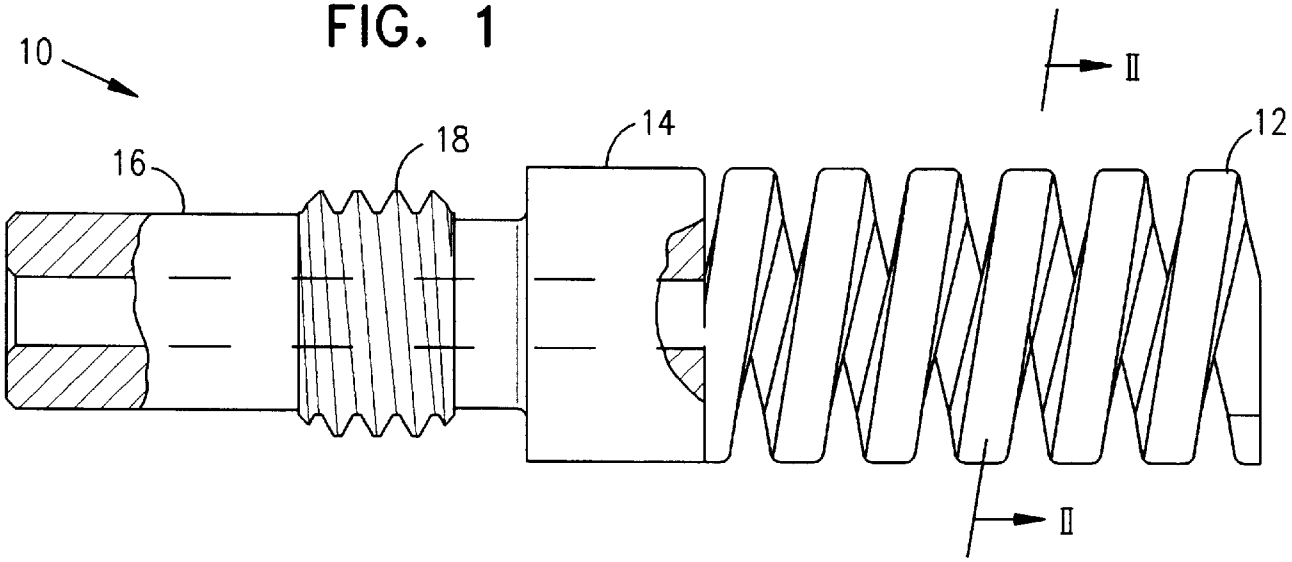
FIG. 1 is a schematic, partly sectional illustration of a helical antenna, according to a preferred embodiment of the present invention.

FIG. 1 is a schematic, sectional view of a helical antenna 10, according to a preferred embodiment of the present invention. FIG. 2A is a schematic, cross-sectional view of the antenna, taken along line II—II. Antenna 10 comprises a helical coil 12, attached to a shoulder section 14. Coil 12 preferably has a generally circular cross-section, as shown in FIG. 2A. At the opposite side of shoulder section 14, the antenna includes a stud 16, having a thread 18. Antenna 10 is designed to operate particularly as a cellular telephone antenna in the 800 MHz band. As shown in the figure, coil 12 preferably comprises 6 turns at a radius of 3.0 mm and a pitch of 2.0 mm.

Antenna 10 is preferably molded as a single, integral unit, using molding techniques known in the art. The material from which the antenna is molded may include any suitable plastic; plastic or other organic binder containing conducting particles; zinc or any other moldable conductive material; or any other moldable material that may be coated with a conductive material. After molding, the parts of antenna 10 are substantially rigid and resilient, like a coil spring, so that coil 12 is self-supporting and maintains its helical form and dimensions without the necessity of an inner core or any other mechanical support. Optionally, a suitable core may be inserted into the central cavity of coil 12 to increase its aperture.

In a preferred embodiment of the present invention, antenna 10 is produced by injection of a suitable thermoplastic material, such as plateable-grade ABS or polycarbonate, into a mold. A core pin is preferably held in the center of the mold during injection to form the central cavity of the antenna. The mold is then opened to release the antenna, and the core pin is removed.

If the material that is used in the mold is not itself conducting, then a step of coating it with conductive material is carried out. The conducting material may, for example, be copper and the coating process may comprise electroplating. Alternatively, any suitable plating or coating method known in the art may be used. It may be desirable that the conductive material only coat a portion of the antenna. In such a case, as is known in the art, a portion of antenna 10 may be masked before coating or, alternatively or additionally, the coating may be etched off a portion of the antenna.

If the material used in the mold is plastic or another organic binder containing metal particles (as in MIM, for example), then a debinding step is carried out at this point to dissolve, evaporate or otherwise remove the plastic. The remaining material is then sintered at high temperature to fuse the metal and increase its conductivity. Details of the production process, including materials, temperatures and times, will be clear to those skilled in the art.

Figure 2B:
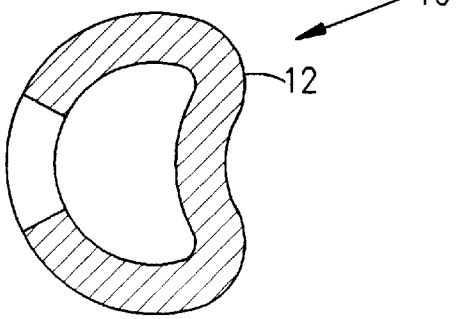
FIG. 2B is a schematic, cross-sectional view of an antenna similar to the antenna of FIG. 1, in accordance with an alternative preferred embodiment of the present invention.
Figure 2A:
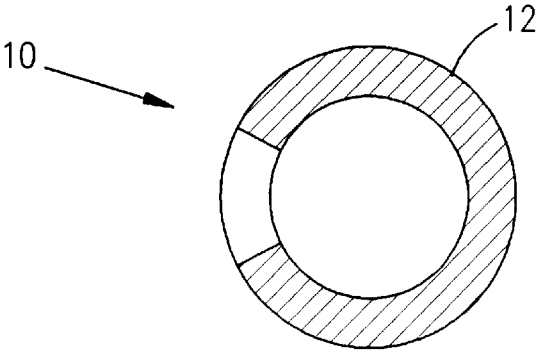
FIG. 2A is a schematic, cross-sectional view of the antenna of FIG. 1.

FIG. 2B is a schematic, cross-sectional view of molded, helical antenna 10, in accordance with an alternative preferred embodiment of the present invention, in which the cross-section of the antenna is non-symmetrical. As described in the above-mentioned Provisional Patent Application 60/048,400, such antennas can be designed to have an enhanced aperture, and in particular a directionally-enhanced aperture, relative to antennas of comparable size having a circular cross-section. Non-circular and non-symmetrical helical antennas are difficult to manufacture by conventional wire-winding methods. The methods of the present invention, however, are particularly well-suited to producing antennas having non-circular and non-symmetrical cross-sections, since these methods substantially eliminate the need for wire winding. By molding the antenna in accordance with the principles of the present invention, non-circular helical antennas may be produced with substantially any desired cross-sectional profile without materially complicating the manufacturing process.

Figure 3:
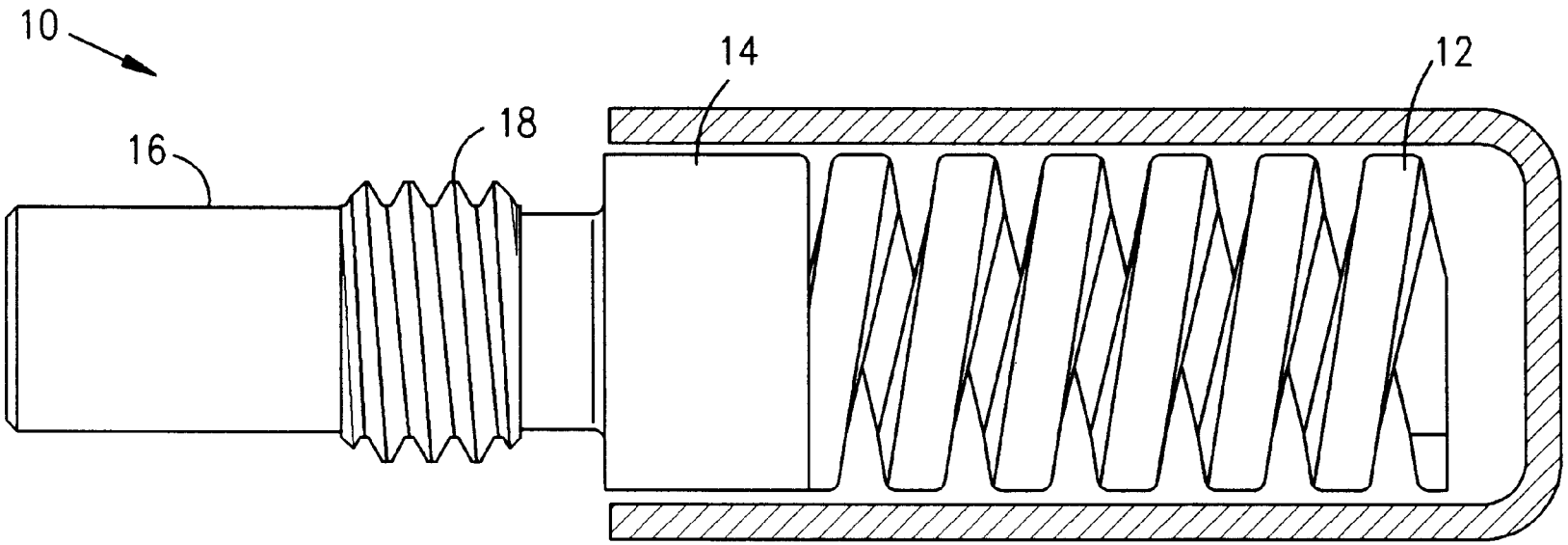
FIG. 3 shows the antenna of FIG. 1, as assembled for use with a cellular telephone.

FIG. 3 is a schematic, sectional illustration showing antenna 10 prepared for assembly. After the antenna has been molded and, as necessary, plated and/or sintered, a protective, insulating cap 20 is fitted over coil 12 and, optionally, over shoulder section 14. Stud 16 is inserted into a suitable receptacle, generally in the case of a cellular telephone, and thread 18 is screwed into a mating thread in the case, until shoulder 14 engages the case's outer surface.

It will be understood that the preferred embodiments of the present invention shown in FIGS. 1–3 is described here by way of illustration only, and the scope of the present invention encompasses a broad range of antennas that may be produced by molding processes. The principles of the invention may also be used in making non-symmetrical antennas, as shown in FIG. 2B, as well as antennas that comprise multiple coils or combinations of coil and whip antenna elements. Such antennas are described, for example, in U.S. Pat. No. 5,650,789, which is incorporated herein by reference.

It will be appreciated that the preferred embodiments described above are cited by way of example, and the full scope of the invention is limited only by the claims.

What is claimed is:

1. A method for producing an antenna comprising:

introducing a moldable material into a mold; and molding the material in the mold into an antenna having a longitudinal axis and a non-circular cross-section perpendicular to said longitudinal axis as a single, integral unit.

2. A method according to claim 1, wherein molding the material comprises forming a helical shape.

3. A method according to claim 1, wherein introducing the material comprises introducing a metal material.

4. A method according to claim 1, wherein introducing the material comprises introducing a plastic material.

5. A method according to claim 4, wherein introducing the plastic material comprises mixing conductive particles into the material.

6. A method according to claim 5, and comprising sintering the molded material.

7. A method according to claim 1, and comprising coating the molded material with a conductive coating.

8. An antenna having a longitudinal axis and a non-circular cross-section perpendicular to said longitudinal axis, comprising a moldable material which is molded as a single, integral unit to produce the non-circular cross-section shape.

9. An antenna according to claim 8, wherein the shape is helical.

10. An antenna according to claim 8, wherein the material comprises metal material.

11. An antenna according to claim 8, wherein the material comprises a plastic material.

12. An antenna according to claim 11, wherein metal particles are mixed into the plastic material.

13. An antenna according to claim 12, wherein the material is sintered after molding.

14. An antenna according to claim 8, wherein the molded material is coated with a conductive coating.

* * * * *